US006323430B1

(12) United States Patent
Finona

(10) Patent No.: US 6,323,430 B1
(45) Date of Patent: Nov. 27, 2001

(54) S-SHAPED CABLE HOLDING CLAMP WITH GROUNDING

(75) Inventor: Michael Santos Finona, Fountain Valley, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/363,916

(22) Filed: Jul. 28, 1999

(51) Int. Cl.[7] ..... H01B 7/00
(52) U.S. Cl. ..... 174/135; 174/70 R
(58) Field of Search ..... 24/130; 174/70 R, 174/97, 135; 439/496, 329, 493, 877, 927; 248/74.2

(56) References Cited

U.S. PATENT DOCUMENTS

| | | | | |
|---|---|---|---|---|
| 3,549,787 | | 12/1970 | Churla, Jr. | 174/78 |
| 4,169,650 | | 10/1979 | Schweizer | 339/198 |
| 4,406,042 | * | 9/1983 | McPhee | 24/130 |
| 4,681,169 | * | 7/1987 | Brookbank, III | 174/97 |
| 4,974,075 | | 11/1990 | Nakajima | 358/98 |
| 5,190,472 | | 3/1993 | Voltz et al. | 439/579 |
| 5,241,135 | | 8/1993 | Fetzer | 174/88 |
| 5,281,762 | | 1/1994 | Long et al. | 174/78 |
| 5,385,490 | | 1/1995 | Demeter et al. | 439/579 |
| 5,713,748 | | 2/1998 | Mulvihill | 439/98 |
| 5,718,607 | | 2/1998 | Murphy et al. | 439/610 |
| 5,768,771 | | 6/1998 | O'Sullivan et al. | 29/828 |
| 5,855,493 | | 1/1999 | Shelly | 439/465 |

* cited by examiner

*Primary Examiner*—Shawn Riley
(74) *Attorney, Agent, or Firm*—Roger C. Turner

(57) ABSTRACT

A clip (30) grips the shields (24) of each of a plurality of cables to hold the front ends of the cables relative to connector contacts (12) and to ground the shields to a shell (16) of the connector. The clip includes a main part (40) that has been bent into a plurality of loops of about 220° each, with alternate loops opening upward and downward. The shields can be installed in the loops by pressing them into the loops, with the opposite sides of the loops resiliently spreading apart as the shield is installed and then closing around it. The loops have holes (80) that permit inspection of the shield at the side of the cable that would otherwise be hidden. A wire (32) that connects the clip to the connector shell, has a wire inner end (82) that extends across a hole, with a quantity of solder (84) soldering the wire to the clip and soldering the wire to a cable shield. The clip has strain relief parts (50), including holders (56) that can grip the cable and flexible couplings (58) that extend rearwardly from the loop.

14 Claims, 2 Drawing Sheets

S-SHAPED CABLE HOLDING CLAMP WITH GROUNDING

BACKGROUND OF THE INVENTION

When a plurality of shielded cables are to be terminated to a connector, the shields of the cables are usually connected to a grounded metal shell of the connector to ground the shields. Also, the cables must be temporarily held in position prior to fixing them as by molding polymer around the cable ends. A simple device that can hold a plurality of cables and electrically connect to their shields so the device can be connected to the grounded shell of the connector, would be of value.

SUMMARY OF THE INVENTION

In accordance with one embodiment of the present invention, a device is provided for use with a connector, to hold a plurality of cables and electrically connect to their shields, where the device is a simple and low cost item. The device is a clip formed of a piece of sheet metal with a main part that has been bent in a somewhat zig-zag fashion to form a plurality of loops, with alternate loops facing upwardly and downwardly. Each loop has opposite sides, with a gap between them, and a cable shield can be installed by pushing the shield through the gap. Each loop has a hole that enables inspection of the shield side that otherwise would be hidden. A wire that connects the clip to the metal shell of the connector, has an inner end that extends across one of the holes, with a quantity of solder soldering the wire and shield to the clip at the hole.

The clip includes strain relief parts, including a flexible coupler that extends from a rear end of a loop and a holder that extends in a single loop to hold a location along the cable that extends rearwardly from a loop. The couplers of alternate loops are of different lengths to avoid interference between holders of adjacent loops.

The novel features of the invention are set forth with particularity in the appended claims. The invention will be best understood from the following description when read in conjunction with the accompanying drawings.

DESCRIPTION OF THE PREFERRED EMBODIMENTS

Figure 6:
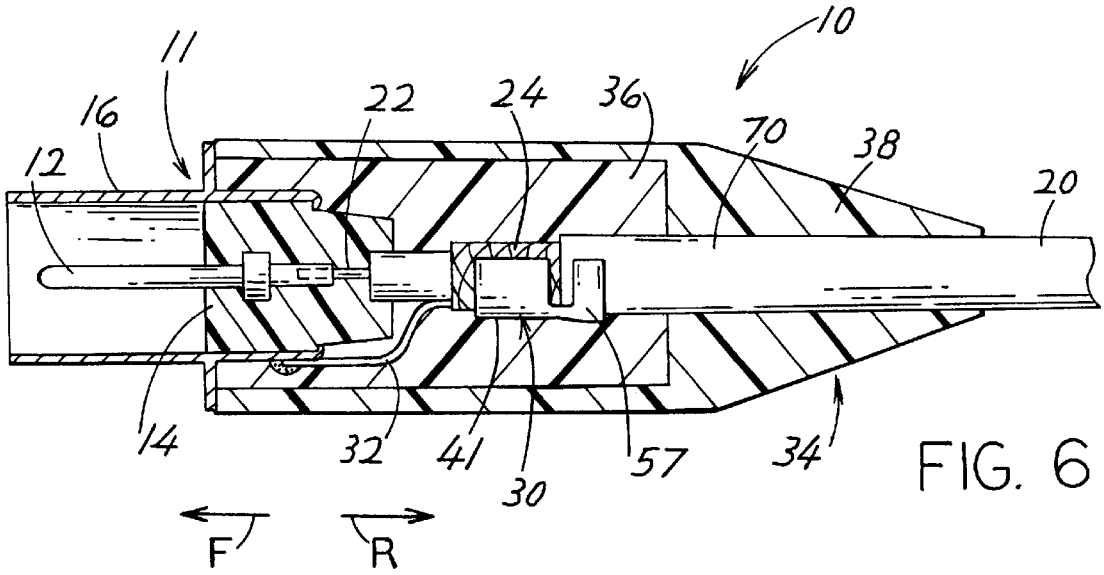
FIG. 6 is a sectional view of a finished connector, with the cables and clip fully installed.

FIG. 6 illustrates a connector 10 with a main part II that has contacts 12 held by an insulator 14, and with the insulator held within a grounded connector shell 16. Cables 20 have inner conductors 22 terminated to the contacts 12.

Each cable has an exposed conductive shield 24 that should be connected to the grounded shell 16 to minimize EMI (electromagnetic interference). A clip 30 serves to temporarily hold the cables in position and electrically connect to the shields24 of the cables. A grounding wire 32 extends from the clip 30 to the grounded shell 16. After the cables have been held and grounded through the clip 30, the front ends of the cables, the clips, and the conductor 32 are encapsulated by polymer material 34. The polymer includes a relatively stiff molded encapsulating portion 36 and a more resilient over-mold portion 38.

Figure 1:
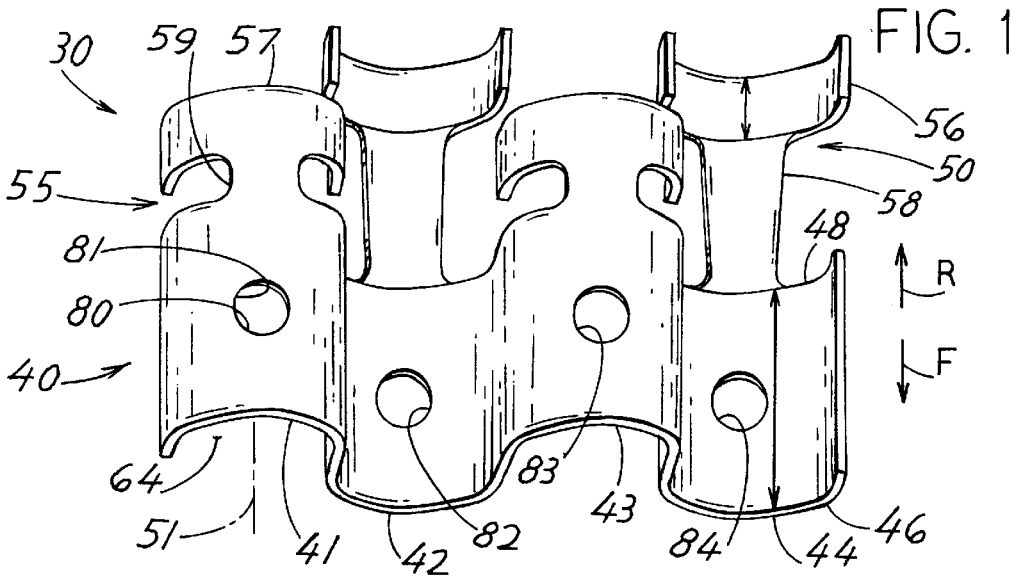
FIG. 1 is an isometric view of a clip constructed in accordance with the invention.

FIG. 1 illustrates the clip 30 which holds the cables and connects to their shields. The clip is formed of a piece of sheet metal with a main part 40 that has been bent by low cost stamping and forming, into a plurality of loops 41–44. Each loop has an axis 51–54 that extends in front and rear directions F, R. Each loop has front and rear ends 46, 48. A strain relief part 50 or 55 extends rearwardly from the rear end of each loop, with each strain relief part including a coupler 58, 59 and a holder 56, 57. When a loop firmly holds a cable, a more rearward portion of the cable is held by the holder such as 56. However, the holder can move up and down by bending of the coupler 58, although the coupler resists such bending to avoid a sharp bend in the cable. The cables are usually oriented, as in FIG. 6, with the loops and holders such as 41, 56 opening upwardly or downwardly, to allow downward sagging of the cable 20 due to its weight.

Figure 2:
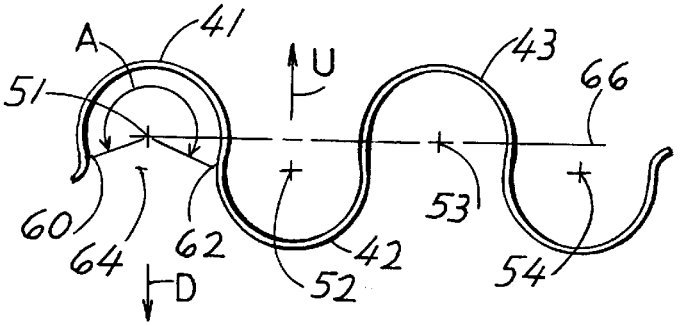
FIG. 2 is a front view of the clip of FIG. 1.

FIG. 2 shows that each loop such as 41 extends by an angle A of more than 180° about the axis 51 of the loop, the particular angle A being 220°. The piece of sheet metal has a spring temper, and the opposite sides 60, 62 of the loop, which is where the gap 64 in the loop is of smallest width, can spread apart to receive the cable, and then close around the cable to prevent it from moving down. The particular angle A of the gap 64 depends upon the resilience of the loop and the acceptable force for insertion of the cable at its shield, but is preferably about 220° (185° to 260°). To facilitate manufacture and provide a simple clip, the axes 51–54 of the loops do not lie in a single plane. The axes 51,53 the first and third loops lie on an imaginary first row line 66. The second and fourth axis 52, 54 are spaced from the row line 66. This enables bending of a single piece of sheet metal as shown, with alternate loops facing downwardly D and upwardly U. The distance of the third and fourth axes 53, 54 from the row line 66 is preferably at least 10% of the diameter of the loops. If the connector is turned, the directions U, D will change, but they will be opposite to each other. It is noted that the loops do not have to be parts of circles, but only have to engage a cylindrical shield at three locations preferably spaced over 90° apart about the axis.

Figure 5:
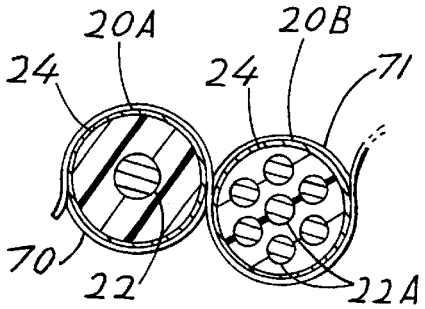
FIG. 5 is a view of a portion of the clip of FIG. 2, and of two different kinds of cables installed into loops of the clip, the cables being shown in sectional views.

FIG. 5 shows two different kinds of cables 20A, 20B. Cable 20A is a coaxial cable, with a single inner conductor 22 centered on the shield 24. Cable 20B is a different type with a plurality of inner conductors 22A which all lie within the shield 24. It is noted that the cables each have a jacket 70, 71 that surrounds the shield 24, with the jacket cut away to expose the shield at the location where the cable is received in a loop, in order to facilitate contact between the shield and the sheet metal at the loop.

Figure 3:
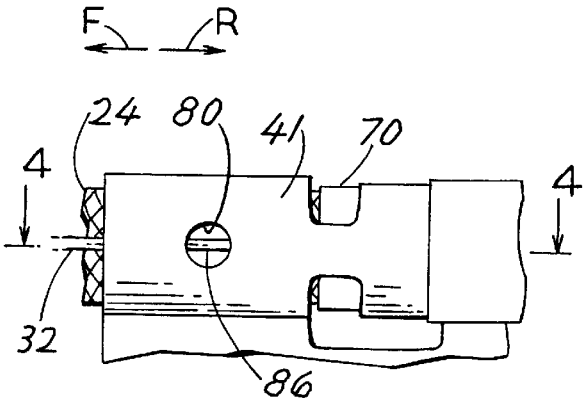
FIG. 3 is a top view of a portion of the clip of FIG. 1, with a cable and wire in place but not yet soldered.
Figure 4:
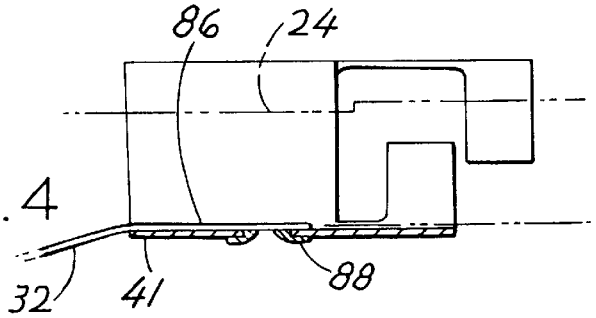
FIG. 4 is a view taken on line 4—4 of FIG. 3, but with the cable shown in phantom lines, and showing a quantity of solder.
Figure 7:
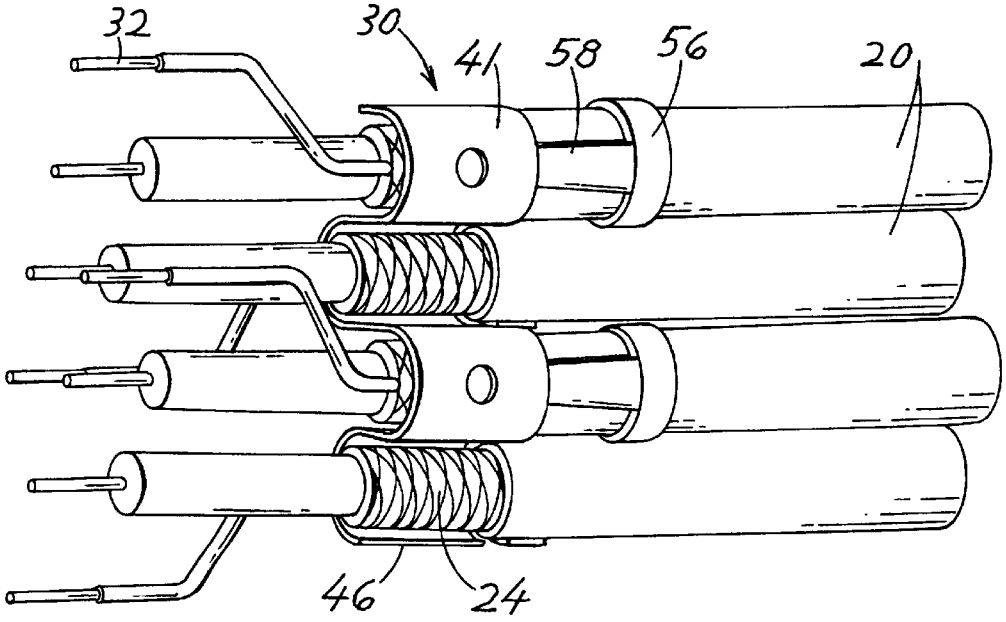
FIG. 7 is an isometric view of the clip of FIG. 1, with the cables and grounding wires fully installed.

FIG. 1 shows that there are holes 80 in the loops, with each loop shown as having a hole 81–84 line at a side of the loop opposite the gap 64. The holes 80 permit inspection of the shield, at a side of the loop that would otherwise would be hidden. Two main types of shields are foils and braidings, with braiding being most common. Both types of shields are delicate and could be damaged when pushed through the loop gap into the loop. A person can inspect the shield through the hole. In addition, as shown in FIG. 3, the hole 80 facilitates soldering of the inner end 86 of the grounding wire 32 to a loop 41 and to the shield 24, and the soldering of the shield to the loop. The inner end 86 of the wire is projected along the inside of the loop and across the hole 80. When the cable shield is installed in the loop, the shield presses the wire end 82 against the loop at the hole. Solder that is already present or that is applied, can be melted, as shown in FIG. 4, where the quantity of solder 88 is shown soldered to the loop 41, the wire inner end 86, and the shield 24. Although it is only necessary to use a single grounding wire 24, applicant prefers to use a grounding wire at each of the loops. FIG. 7 shows a cable and clip assembly with grounding wires 32 at each of the loops.

Instead of using a clip of spring temper, it is possible to use a clip of malleable metal, which is initially largely in the shape shown in FIG. 2, although with the opposite sides 60, 62, preferably longer than as shown in FIG. 2 and with the gaps being only about 180°. In that case, the cable shields are placed through the gaps into the loops and the loops are then deformed to hold the cables in place. Such a use of deformable metal is not preferred, but is possible. It is possible to construct a clip with many loops, where the axis such as 51, 53 of one row of loops is curved instead of straight, for a connector whose contacts lie in a curved row.

As described above, while terms such as "up" and "down" have been used in describing the invention as illustrated, it is possible to use the clip and connector in any orientation with respect to the Earth.

In a clip that applicant has designed for holding cable shields of a diameter of 22 mm, each loop had a length between its opposite ends 46, 48 of 3.3 mm and other dimensions as illustrated in the figures.

Thus, the invention provides a clip, a connector that includes the clip, and the combination of the connector with a plurality of cables, where the clip that holds the cables and grounds them is effective and of simple and low cost construction. The clip is formed of a single piece of sheet metal with a main part that has been bent into a plurality of loops. Where the sheet metal is resilient, the loops extend by at least 180°, preferably by at least 190° and more preferably about 220°, so a cable shield can be snapped into place in a loop. The loops are formed so the axes of first and third loops lie on a line and the axes of a second loop that lies between them is spaced from that line. At least one of the loops and preferably all of them have holes for inspection, with at least one grounding wire soldered at a hole to the shield and to the loop, with the other end of the grounding wire soldered to a metal shell of the connector. The clip has strain relief parts at its rear ends, including couplers that extend less than 90° about each loop axis, although with some resistance, and with holders lying behind the couplers to hold the cable jacket.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. The combination of a connector main part which has a plurality of contacts, a clip, and a plurality of cables that each has an exposed conductive shield and at least one inner conductor within the shield, wherein:

said connector has an electrically conductive shell and has an insulator that surrounds and holds said contacts and that is mounted in said shell;

said clip comprises a piece of sheet metal that has been bent into a plurality of loops about one of a plurality of corresponding axes, with said cable shields each lying within one of said loops and with said inner conductors connected to said contacts;

said shields on said cables each lies within a different one of said loops, with each loop tightly surrounding a corresponding cable shield, and with said clip being electrically connected to said shell.

2. The combination described in claim 1 including:

a wire having an inner end soldered to one of said loops and having an outer end soldered to said shell;

a quantity of polymer material that is molded around said clip, around portions of said cables, and around said inner and outer ends of said wire.

3. The combination described in claim 1 wherein:

at least one of said loops has a hole, with solder lying at said hole and soldering the corresponding loop to the shield of the corresponding cable.

4. Apparatus for holding a plurality of electrical cables that each has an electrically conductive shield comprising:

a piece of sheet metal that has been bent into at least three loops with each loop having an axis and with each loop extending by more than 180° about its axis, with first and third of said axes lying on an imaginary first row line and with a second axis spaced from said first row line, each of such loops has opposite sides, with the opposite sides of a second loop that has said second axis merging with the opposite sides of first and third loops that have said first and third axes, and with said first and third loops opening in a first direction and said second loop opening in a second direction that is opposite to said first direction.

5. The apparatus described in claim 4 wherein:

each of said loops has a hole lying in a portion of the loop that is opposite its direction of opening, to thereby enable viewing of an otherwise concealed side a shield.

6. The apparatus described in claim 4 including said plurality of cables with each cable having its shield exposed and lying in one of said loops, including:

a plurality of quantities of solder each lying in one of said holes and soldering a shield of one of said cables to one of said loops.

7. The apparatus described in claim 4 wherein:

each of said loops has opposite ends spaced apart in a direction parallel to its axis;

said piece of sheet metal forms at least one strain relief part which includes a holder and a coupler, with said holder bent into a holder loop part that is of about the same shape as a first of said loops as viewed along said axis to hold one of said cables, and which is aligned with said first loop as viewed along said axis, and with said coupler extending axially between said first loop and said holder and with said coupler extending less 90° about said axis to allow said coupler to bend.

8. Apparatus for use with a connector, to hold a plurality of cables that each has an electrically conductive shield of a predetermined outside diameter, to enable connection of the shields of said cables to a common ground of the connector, comprising:

a clip formed of a piece of sheet metal with a main part that has been bent into a plurality of loops of at least 180° each, with said loops each having a pair of opposite sides with each pair of opposite ends forming a loop gap with said loop gaps alternately opening upwardly and downwardly, with each loop being of a size to hold one of said cable shields and with said sheet metal being deflectable to allow each cable shield to be pushed through one of said loop gaps into one of said loops;

a grounding wire connected to said clip and to said common ground of said connector and extending between them.

9. Apparatus for use with a connector, to hold a plurality of cables that each has an electrically conductive shield of a predetermined outside diameter, to enable connection of the shields of said cables to a common ground of the connector, comprising:

a clip formed of a piece of sheet metal with a main part that has been bent into a plurality of loops of at least 180° each, with said loops each having a pair of opposite sides with each pair of opposite ends forming a loop gap with said loop gaps alternately opening upwardly and downwardly, with each loop being of a size to hold one of said cable shields and with said sheet metal being deflectable to allow each cable shield to be pushed through one of said loop gaps into one of said loops;

said clip has a plurality of holes, with each hole lying between the opposite sides of the loop, to provide a hole to view the hidden side of the shield and to allow soldering through the hole.

10. The apparatus described in claim 9 including said cables with one of said cables lying in one of said loops, and further including:

a quantity of solder that lies in one of said holes and that solders the shield of said one of said cables to a corresponding one of said loops of said clip.

11. The apparatus described in claim 10 including:

a wire of conductive material which has an inner end that lies in said one of said loops at the hole of that loop and which has an outer end that projects from said clip, with said quantity of solder joined to said wire inner end as well as to said one of said loops of said clip.

12. Apparatus for use with a connector, to hold a plurality of cables that each has an electrically conductive shield of a predetermined outside diameter, to enable connection of the shields of said cables to a common ground of the connector, comprising:

a clip formed of a piece of sheet metal with a main part that has been bent into a plurality of loops of at least 180° each, with said loops each having a pair of opposite sides with each pair of opposite ends forming a loop gap with said loop gaps alternately opening upwardly and downwardly, with each loop being of a size to hold one of said cable shields and with said sheet metal being deflectable to allow each cable shield to be pushed through one of said loop gaps into one of said loops;

each of said loops has an axis with said axes being approximately parallel, and each loop has opposite front and rear ends spaced apart in a direction parallel to its axis;

said piece of sheet metal forms a plurality of strain relief parts which each includes a holder that is axially aligned with one of said loops and a coupler, with said holders each bent into a holder loop part that is of about the same shape as a corresponding one of said loops as viewed along a corresponding one of said axes to hold one of said cables, and which is aligned with a corresponding one of said loops as viewed along a corresponding one of said axes;

said couplers each extending axially between one of said loops and a corresponding one of said holders, with each coupler extending less than 90° about the axis of the corresponding loop to allow the coupler to bend;

alternate ones of said couplers are of different axial lengths, to axially space alternate ones of said holders so they do not touch one another.

13. Apparatus for use with a connector, to hold a plurality of cables that each has an electrically conductive shield of a predetermined outside diameter, to enable connection of the shields of said cables to a common ground of the connector, comprising:

a clip formed of a piece of sheet metal with a main part that has been bent into at least three loops of more than 180° each, with said loops each having a pair of opposite sides with each pair of opposite ends forming a loop gap with said loop gaps alternately opening upwardly and downwardly, with each loop being of a size to hold one of said cable shields and with said sheet metal being deflectable to allow each cable shield to be pushed through one of said loop gaps into one of said loops;

said plurality of loops including first and third loops opening downwardly and having axes that lie on a row line and a second loop connecting said first and third loops and opening upwardly;

said second loop having an axis that lies below said row line.

14. Apparatus for use with a connector, to hold a plurality of cables that each has an electrically conductive shield of a predetermined outside diameter, to enable connection of the shields of said cables to a common ground of the connector, comprising:

a clip formed of a piece of sheet metal with a main part that has been bent into a plurality of loops of at least 180° each, with said loops each having a pair of opposite sides with each pair of opposite ends forming a loop gap with said loop gaps alternately opening upwardly and downwardly, with each loop being of a size to hold one of said cable shields and with said sheet metal being deflectable to allow each cable shield to be pushed through one of said loop gaps into one of said loops;

each of said loops has an axis and has opposite ends spaced apart in a direction parallel to said axis;

said piece of sheet metal forms at least one strain relief part which includes a holder and a coupler with said holder bent into a holder loop part that is of about the same shape as a first of said loops as viewed along said axis to hold one of said cables, and which is aligned with said first loop as viewed along said axis, but with said holder having an axial length that is less than the length of said first loop, and with said coupler extending axially between said first loop and said holder and with said coupler extending less 90° about said axis to allow said coupler to bend.

* * * * *